US009683564B2

(12) United States Patent
Meyer et al.

(10) Patent No.: US 9,683,564 B2
(45) Date of Patent: Jun. 20, 2017

(54) INTERNAL GEAR PUMP WITH IMPROVED COMMUNICATION BETWEEN INLET AND IDLER AND BETWEEN INLET AND ROTOR

(71) Applicant: Viking Pump, Inc., Cedar Falls, IA (US)

(72) Inventors: Scott M. Meyer, Brandon, IA (US); Emily P. Timm, Waterloo, IA (US); Christopher J. Mihm, Cedar Falls, IA (US); Nicolas V. Thompson, Cedar Falls, IA (US)

(73) Assignee: Viking Pump, Inc., Cedar Falls, IA (US)

( * ) Notice: Subject to any disclaimer, the term of this patent is extended or adjusted under 35 U.S.C. 154(b) by 229 days.

(21) Appl. No.: 14/681,279

(22) Filed: Apr. 8, 2015

(65) Prior Publication Data

US 2016/0298623 A1 Oct. 13, 2016

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 2/08*** | (2006.01) |
| ***F04C 14/18*** | (2006.01) |
| ***F01C 1/10*** | (2006.01) |
| ***F04C 2/10*** | (2006.01) |
| *F04C 15/00* | (2006.01) |

(52) U.S. Cl.

CPC ..... *F04C 2/084* (2013.01); *F01C 1/102* (2013.01); *F04C 2/101* (2013.01); *F04C 14/185* (2013.01); *F04C 15/0038* (2013.01); *F04C 2/086* (2013.01); *F04C 15/0073* (2013.01)

(58) Field of Classification Search

CPC ..... F04C 2/084; F04C 2/086; F04C 2/101; F04C 14/185; F04C 15/0038; F04C 15/0073; F01C 1/102

USPC ..... 418/1, 104, 169–170; 29/888.02, 29/888.023

See application file for complete search history.

(56) References Cited

U.S. PATENT DOCUMENTS

| | | | | |
|---|---|---|---|---|
| 1,496,737 A * | 6/1924 | Petersen | F04C 2/101 | 418/169 |
| 1,853,430 A * | 4/1932 | Jensen | F04C 2/101 | 418/169 |
| 1,896,033 A * | 1/1933 | Sperry | F04C 2/101 | 418/170 |
| 2,481,560 A * | 9/1949 | Bakewell | F04C 2/101 | 418/170 |

(Continued)

*Primary Examiner* — Theresa Trieu
(74) *Attorney, Agent, or Firm* — Miller, Matthias & Hull

(57) ABSTRACT

This document discloses an internal gear pump with a symmetrical casing and a head design that enables high pumping speeds, reduced turbulence and reduced risk or occurrence of cavitation. The head includes a boss that extends into the pump chamber to form an idler support and a crescent support. The crescent support includes a liquid directing step that extends from the crescent arcuately towards the inlet. The liquid directing step divides liquid incoming from the inlet into a portion directed to an idler feed slot and another portion directed to a rotor feed slot. The idler feed slot provides communication between the inlet and the roots of the idler and the rotor feed slot provides communication between the inlet and spaces between the rotor teeth.

20 Claims, 6 Drawing Sheets

(56) References Cited

U.S. PATENT DOCUMENTS

| | | | | |
|---|---|---|---|---|
| 3,276,387 | A * | 10/1966 | Bottoms | F04C 2/101 418/170 |
| 6,149,415 | A | 11/2000 | Thompson et al. | |
| 6,158,994 | A | 12/2000 | Mulcahy | |
| 6,314,642 | B1 * | 11/2001 | Thompson | F04C 2/101 418/170 |
| 6,352,419 | B1 | 3/2002 | Thompson et al. | |
| 6,659,728 | B2 | 12/2003 | Bush et al. | |

* cited by examiner

INTERNAL GEAR PUMP WITH IMPROVED COMMUNICATION BETWEEN INLET AND IDLER AND BETWEEN INLET AND ROTOR

BACKGROUND

Technical Field

This document discloses an internal gear pump for high speed pumping of liquids. The pump features a head that features rotor feed slot that directs flow from the inlet to the rotor teeth, an idler feed slot that directs flow from the inlet to the idler teeth and a crescent configuration that includes a liquid directing step that separates the idler and rotor feed slots. The crescent further includes a tapered leading edge. The pump also features a casing with symmetrical porting that enables the flow direction to be reversed by replacing only the head.

Description of the Related Art

Internal gear pumps are capable of efficiently pumping low to moderate viscosity liquids at relatively high speeds. A typical internal gear pump includes a rotor mounted to a shaft. The rotor includes a plurality of circumferentially disposed, spaced-apart and inwardly directed rotor teeth that also extend axially toward an open end of the pump casing. A head covers the open end of the pump casing and the head connects to an idler by an idler pin mounted to the head eccentrically with respect to the shaft and rotor teeth. The idler includes a plurality of idler teeth disposed between alternating idler roots. In contrast to the rotor teeth, which taper as they extend radially inward, the idler teeth taper as they extend radially outward.

A crescent or sealing wall is disposed below the idler and radially within the rotor teeth. The crescent directs some of the incoming liquid to the idler teeth and some of the incoming liquid to the rotor teeth. The rotor teeth rotate below or along a lower side of the crescent while the idler teeth rotate above or along an upper side of the crescent before the idler and rotor teeth rotate past the outlet and intermesh with each other at the top of the pump. The crescent provides as seal between the outlet and inlet as an idler tooth engages the upper side of the crescent and as a rotor tooth engages the lower side of the crescent. Further, as the idler and rotor teeth intermesh at a position opposite the idler pin from the crescent (and generally equidistant from the inlet and outlet), the intermeshed idler and rotor teeth also act as a seal between the inlet and outlet. These seals help to force the liquid out of the pump chamber through the outlet and help to reduce slip, or the migration of liquid from the outlet back to the inlet. Because slip results in liquid being recycled within the pump, it reduces the pumps total flow rate and therefore the efficiency of the pump.

Incoming liquid from the inlet flows either to spaces between the rotor teeth prior to the rotor teeth rotating along the lower side the crescent or to roots disposed between adjacent idler teeth prior to the idler teeth rotating along the upper side of the crescent. The roots between the idler teeth may be loaded in two ways: radially and axially. Radial loading of the idler teeth occurs when fluid passes between adjacent rotor teeth before flowing into a root disposed between adjacent idler teeth. Axial loading of the idler teeth occurs when liquid, disposed in an area between the head and the idler, flows axially into a root as the idler and rotor teeth rotate from an intermeshed position and towards the inlet.

It is difficult to ensure a complete loading of the idler roots. The failure to provide a complete loading of the idler roots reduces pump efficiency. Similarly, it is difficult to ensure a complete loading of the spaces between the rotor teeth. The failure to provide a complete loading of rotor teeth also results in reduced pump efficiency. Therefore, there is a need for a way to improve the loading of the idler roots and/or the spaces between rotor teeth of internal gear pumps as a means for increasing pump efficiency.

Cavitation describes the phase change from liquid to gas (boiling) that occurs in a pump when the inlet pressure falls below the vapor pressure of the liquid being pumped, thereby causing vapor bubbles. Because vapor bubbles take up more volume than the liquid, a reduction in liquid flow occurs. As the vapor bubbles move from the inlet of the pump towards the roots of the idler teeth, the bubbles collapse back into the liquid phase and, at the moment of collapse or implosion, a powerful shockwave develops within the liquid. This shockwave can damage the idler, creating pits. In an internal gear pump, cavitation can be caused by operating the pump at high speeds. Specifically, as the idler and rotor teeth move from an intermeshed relationship at a position opposite the idler pin from the crescent to a separated relationship at the inlet, a low-pressure condition can develop which can lead to cavitation. While reducing the pump speed can alleviate this problem, reducing the pump speed also reduces the pump output, which can be disadvantageous. Because increasing the pressure of the liquid delivered to the inlet may not be an option, there is a need for an improved internal gear pump designs, which permit high-speed operation of the pump while limiting the effects of cavitation. Further, there is a need for improved internal gear pumps wherein the speed at which cavitation begins to occur is higher than in currently available designs.

SUMMARY OF THE DISCLOSURE

In one aspect, this document discloses an internal gear pump. The disclosed internal gear pump may include a casing including an inlet, an outlet, and an open outboard end and an inboard end through which a rotor shaft passes. The open outboard end may be enclosed by a head. The head and casing may define a pump chamber. The rotor shaft may have a central axis and may be connected to a rotor disposed in the pump chamber. The head may include an inner surface that faces the pump chamber. The inner surface may be connected to a boss that extends into the pump chamber. The boss may include an idler support connected to a crescent support. The idler support may be rotatably connected to an idler having an idler axis. The crescent support may be partially covered by and connected to a crescent that extends away from the head and that is disposed below the idler. The crescent support may further comprise a liquid directing step that extends from the crescent towards the inlet. The boss may include a lower wall disposed below the crescent support and that extends from the crescent support downward to the casing. The boss, inner surface of the head and the casing may define a rotor feed slot disposed between the liquid directing step and the casing, wherein the rotor feed slot extends from the lower wall towards the inlet for providing communication between the inlet and the rotor.

This document also discloses another internal gear pump, which may include a casing comprising an inlet, outlet, an open outboard end, and an inboard end through which a rotor shaft passes. The open outboard end may be enclosed by a head. The head and the casing may define a pump chamber. The head may include an inner surface that faces the pump chamber and that is connected to a boss that extends from the inner surface into the pump chamber. The boss may include an idler support connected to a crescent support. The idler support may be rotatably connected to an idler that has an idler axis. The crescent support may be partially covered by and connected to a crescent that extends away from the head and that is disposed below the idler. The crescent support may further include a liquid directing step that extends from the crescent towards the inlet. The rotor may include a plurality of circumferentially disposed rotor teeth that extend radially inwards toward the central axis. The idler may include a plurality of idler teeth that extend radially outwards away from the idler axis. The boss may include a lower wall disposed below the crescent support and that extends from the crescent support downward to the casing. The boss, the casing, and the inner surface of the head may define a rotor feed slot disposed between the liquid directing step and the casing, wherein the rotor feed slot extends from the lower wall towards the inlet for providing communication between the inlet and the rotor teeth.

In another aspect, this document discloses a method for pumping liquid at a high speeds. The method may include providing an internal gear pump that may include a casing comprising an inlet, an outlet, an open outboard end and inboard end through which a rotor shaft passes. The open outboard end may be enclosed by a head. The head and casing may define a pump chamber. The rotor shaft may have a central axis. The rotor shaft may be connected to a rotor disposed in the pump chamber. The head may include an inner surface that faces the pump chamber. The inner surface may be connected to a boss that extends from the inner surface into the pump chamber. The boss may include an idler support connected to a crescent support by a middle wall. The idler support may be rotatably connected to an idler having an idler axis. The crescent support may be partially covered by and connected to a crescent that extends away from the head and that is disposed below the idler. The crescent support may further comprise a liquid directing step that extends from the crescent and towards the inlet. The boss and the head may define an idler feed slot disposed between the liquid directing step and the idler support and that extends from the middle wall towards the inlet. The rotor may comprise a plurality of circumferential disposed rotor teeth extending radially inwards towards the central axis. Conversely, the idler may include a plurality of idler teeth extending radially outwards away from the idler axis and disposed radially within the rotor teeth. The boss may include a lower wall disposed below the crescent support and that extends from the crescent support downwards to the casing. The boss, the casing and the inner surface of the head may define a rotor feed slot disposed between the liquid directing step and the casing and that extends from the lower wall towards the inlet. The method may further include rotating the rotor shaft and the rotor, directing fluid from the inlet through the idler feed slot to the idler teeth and directing fluid from the inlet through the rotor feed slot to the rotor teeth.

The above method may further include providing an upper wall disposed opposite the idler axis from the crescent and that extends from the idler support upward to the casing. The method may further include blocking flow from the inlet to the outlet with the upper wall and lower wall without said flow first passing through either the rotor feed slot or the idler feed slot. The upper wall may also prevent liquid from flowing from the outlet back to the inlet.

In any one or more of the embodiments described above the boss may include a middle wall that connects the crescent support to the idler support. The boss and the head may define an idler feed slot that is disposed between the liquid directing step and the idler support and that may extend from the middle wall towards the inlet for providing communication between the inlet and the idler.

In any one or more of the embodiments described above, the middle wall, lower wall, idler support and crescent support may terminate at surfaces that are coplanar with respect to each other.

In any one or more of the embodiments described above, the boss may include an upper wall disposed opposite the idler axis from the crescent and that extends from the idler support upward towards the casing.

In any one or more of the embodiments described above, the upper wall, middle wall, lower wall, idler support and crescent support may terminate at surfaces that are coplanar with respect to each other.

In any one or more of the embodiments described above, the idler support and the crescent support may terminate at surfaces that are coplanar with each other.

In any one or more of the embodiments described above, the rotor may encircle the idler and the crescent.

In any one or more of the embodiments described above, the inlet connects to the pump chamber by an inlet passageway and the outlet connects to the pump chamber by an outlet passageway. Further, the inlet and outlet passageways are symmetrical or, in other words, the inlet and outlet passageways are mirror images of each other when the plane mirror is vertical and passes through the axis of the rotor shaft.

BRIEF DESCRIPTION OF THE DRAWINGS

For a more complete understanding of the disclosed methods and apparatuses, reference should be made to the embodiment illustrated in greater detail in the accompanying drawings, wherein:

FIG. 10 is a front plan view of the head with the idler mounted there on.

The drawings are not necessarily to scale and may illustrate the disclosed embodiments diagrammatically and in partial views. In certain instances, this disclosure may omit details which are not necessary for an understanding of the disclosed methods and apparatuses or which render other details difficult to perceive. Further, this disclosure is not limited to the particular embodiment illustrated herein.

DETAILED DESCRIPTION OF THE DRAWINGS

Figure 1:
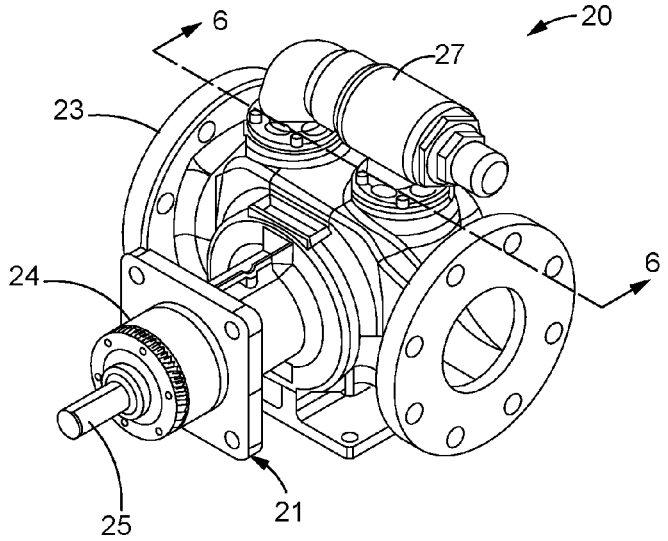
FIG. 1 is a front perspective view of a disclosed gear pump.
Figure 2:
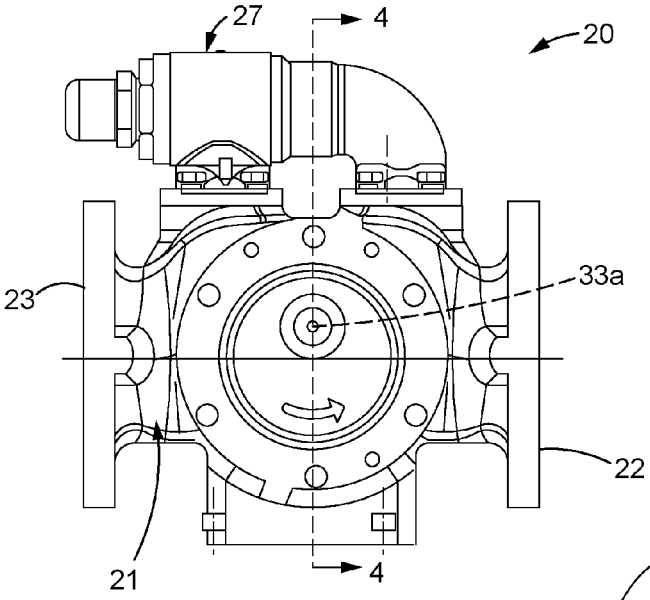
FIG. 2 is a rear plan view of the internal gear pump showed in FIG. 1.
Figure 3:
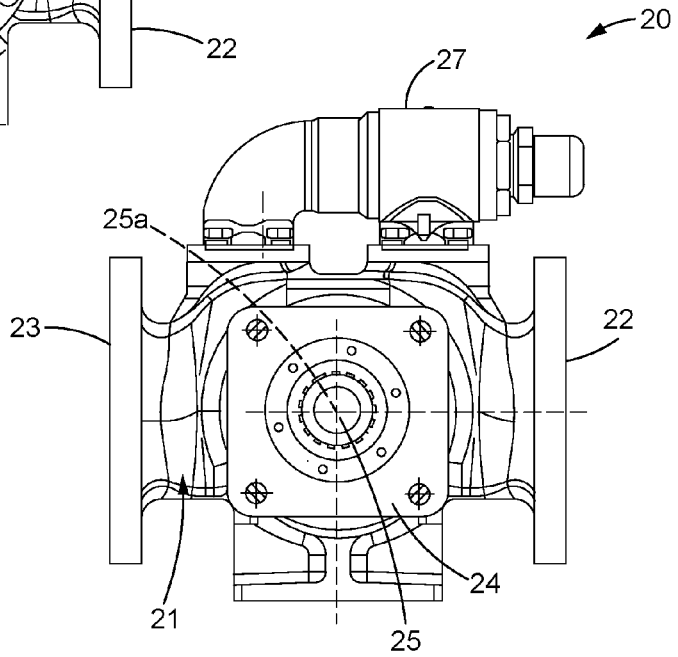
FIG. 3 is a front plan view of the internal gear pump showed in FIG. 1.
Figure 4:
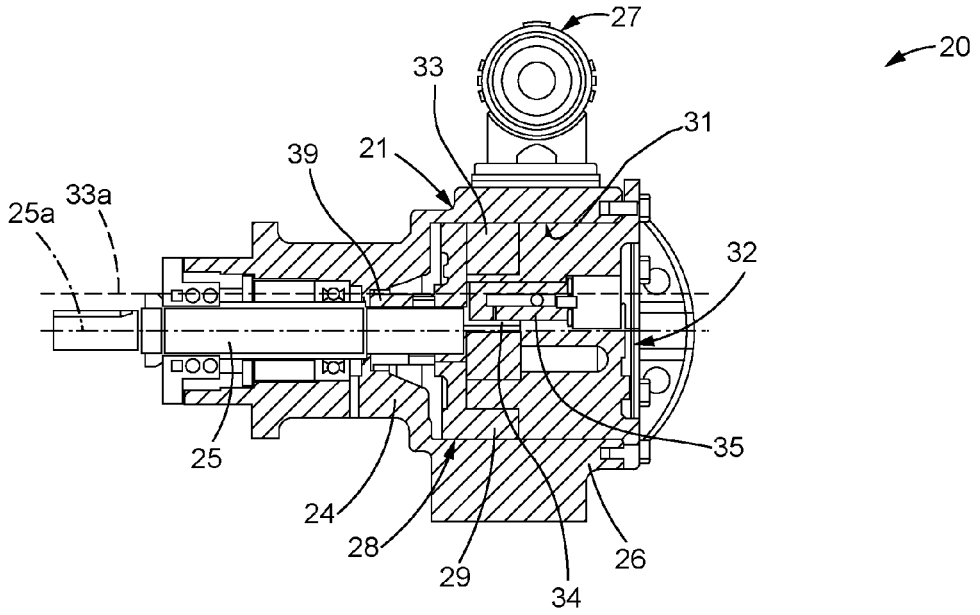
FIG. 4 is a sectional view taken substantially along line 4-4 of FIG. 2.

FIGS. 1-3 provide exterior views of a disclosed internal gear pump 20. The pump 20 includes the casing 21 including an inlet 22 and an outlet 23. The casing 21 further includes an inboard end 24 through which a rotor shaft 25 passes in an open outboard end 26 shown in FIG. 4. The casing 21 may couple to a relief valve assembly 27, also shown in FIG. 5. Further, as shown in FIGS. 3 and 4, the rotor shaft 25 may define a central axis 25*a* of the pump chamber 31. Further, as shown in FIGS. 2 and 4, the idler 33 rotates about an idler axis 33*a* offset from the central axis 25*a* of the pump chamber 31 and rotor shaft 25.

Figure 5:
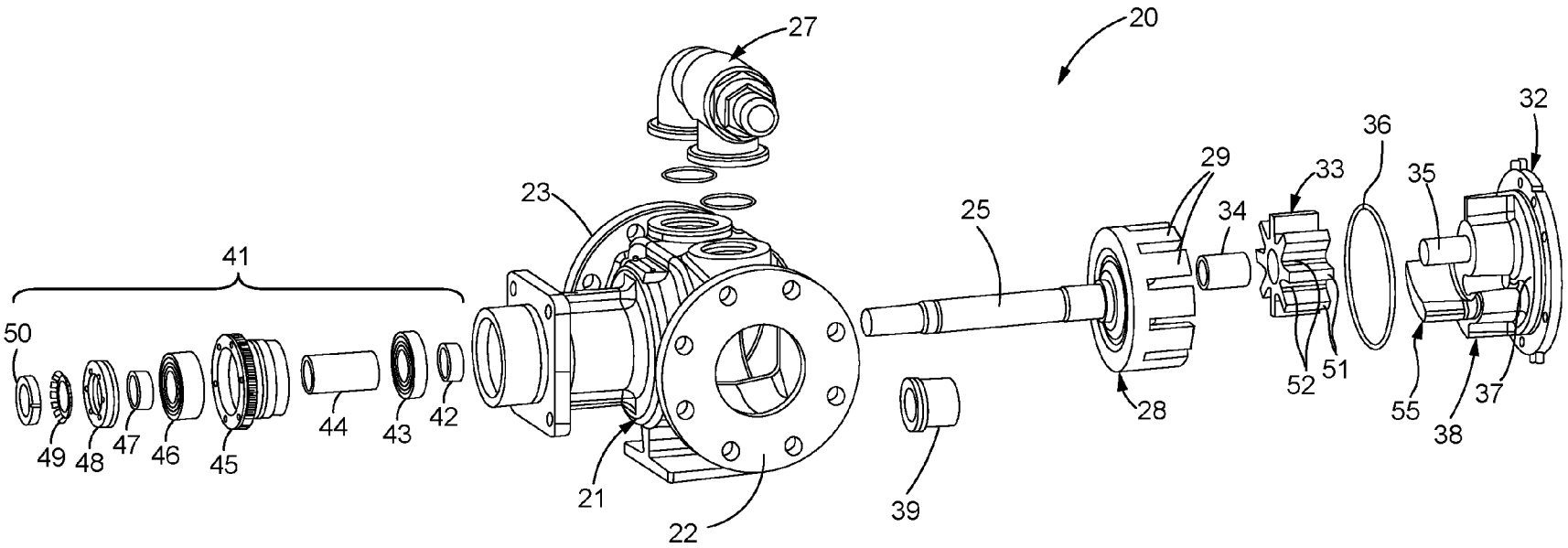
FIG. 5 is an exploded view of the internal gear pump showed in FIGS. 1-4.

FIGS. 4-5 further illustrate various components of the pump 20. The rotor shaft 25 is connected a rotor 28. The rotor 28 includes a plurality circumferentially spaced-apart rotor teeth 29. The rotor teeth 29 extend axially into a pump chamber 31 (FIG. 4) that is defined by the casing 21 and the head 32, and which encloses the outboard end 26 of the casing 21 as shown in FIG. 4. The rotor 28 and an idler 33 are disposed within the pump chamber 31. The idler 33 rotatably couples to the head 32 using an idler bushing 34 and idler pin 35 (FIG. 5). An O-ring 36 seals the connection between the head 32 and the open outboard end 26 of the casing 21. The head 32 includes an inner surface 37 (FIGS. 6-8) that includes or connects to a boss 38, the details of which are described below in connection with FIGS. 7-8. While the O-ring 36 and head 32 seal the open outboard end 26 of the casing 21, the rotor shaft 25 passes through the seal 39 to seal the inboard end 24 of the casing 21. In addition to passing through the seal 39, the rotor shaft 25 also passes through a bearing assembly 41 that may include a spacer 42, a bearing 43, a spacer 44, a bearing housing 45, a bearing 46, a spacer 47, a bearing endcap 48, a lock washer 49 and a lock nut 50 as shown in FIG. 5.

Figure 6:
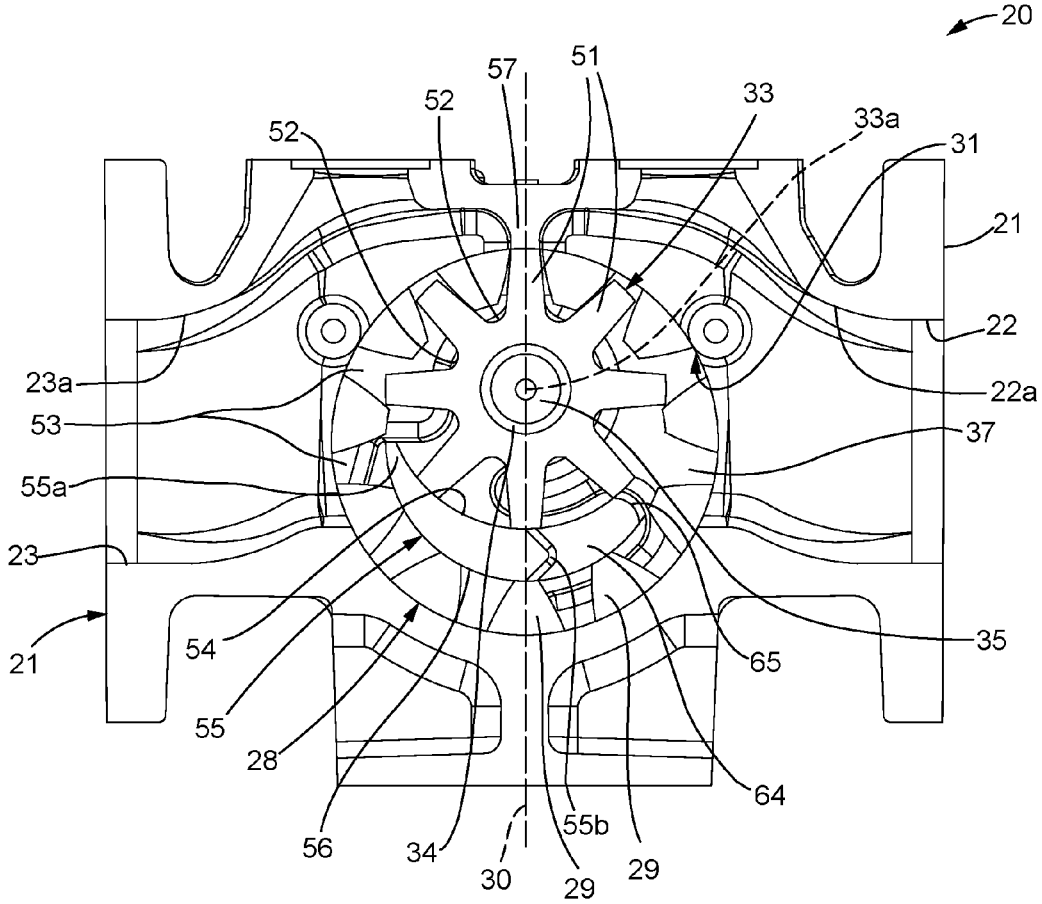
FIG. 6 is a sectional view taken substantially along lines 6-6 of FIG. 1

FIG. 6 provides a front view of the pump chamber 31, the idler 33 and a sectional view of the rotor 28. As noted above, the casing 21 includes an inlet 22 and an outlet 23. The inlet 22 connects to the pump chamber 31 by an inlet passageway 22*a* and the outlet 23 connects to the pump chamber 31 by an outlet passageway 23*a*. The pump 20 is configured so that the rotor shaft 25, rotor 28, and idler 33 rotate in the clockwise direction. However, because of the symmetrical nature of the inlet 22 and outlet 23 and the symmetrical nature of the inlet passageway 22*a* and the outlet passageway 23*a*, the direction of the pump 20 may be easily reversed by changing the head 32 without changing the casing 21. Thus, the casing 21 can accommodate flow in either direction. To reverse the flow of the pump 20, a mirror image of the head 32 may be substituted for the head 32 as shown, without changing the casing 21, because the inlet 22 is disposed diametrically opposite the pump chamber 31 from the outlet 23 (and vice versa) and further because the inlet passageway 22*a* and outlet passageway 23*a* are also symmetrical. In other words, the inlet and outlet passageways 22*a*, 23*a* are mirror images of each other using a plane mirror passes through both the central axis 25*a* (FIG. 4) of the pump chamber 31 and the idler axis 33*a* (FIG. 6). For example, in the example shown in FIG. 6, such a plane mirror passes through the line 30 and extends perpendicularly out of the page. By locating the inlet 22 and outlet 23 at the three o'clock and nine o'clock positions respectively and by employing symmetrical inlet and outlet passages 22*a*, 23*a*, the disclosed pump 20 may be more easily reversed and all a manufacturer needs to do is manufacture one casing 21 and two heads 32 that are mirror images of one another.

Applicant uses the terms top, bottom, vertical, horizontal, three o'clock position and nine o'clock position to assist the reader in understanding this description and the attached drawings. The disclosed pump 20 need not be used exclusively in the orientation shown in the drawings where a horizontal plane passes through axial centers of the inlet 22 and outlet 23 and a vertical plane passes through the central axis 25*a* and idler axis 33*a* (and the line 30 of FIG. 6). In other words, the inlet 22 and outlet 23 may be disposed in any common plane and said common plane need not be horizontal as the effects of gravity on liquids pumped at high speeds by the disclosed pump 20 are minimal. And, of course, the plane mirror for the inlet passageway 22*a* (and the inlet 22) and the outlet passageway 23*a* (and the outlet 23) need not be vertical as indicated by the line 30 in FIG. 6.

Still referring to FIG. 6, the idler 33 includes a plurality of radially outwardly extending idler teeth 51 that are disposed between alternating idler roots 52. In contrast to the rotor teeth 29, the idler teeth 51 may taper as they extend radially outward away from the idler pin 35. The idler 33 may be fabricated from a high strength and/or hardened material to avoid damage from cavitation while operating the pump 20 at high speeds. Further, the circumferentially disposed rotor teeth 29 are separated by spaces 53, which receive the idler teeth 51 at the top of the pump 20 as shown in FIG. 6 (or equidistantly between the inlet 22 and outlet 23 along the path of rotation of the rotor teeth 29). At the top of the pump 20, the idler teeth 51 intermesh with the rotor teeth 29. As the idler teeth 51 and the rotor teeth 29 rotate in the clockwise direction from the top of the pump 20 towards the inlet 22, the idler teeth 51 become disengaged from the rotor teeth 29, which creates low-pressure areas near the inlet 22. These low-pressure areas draw liquid into the pump chamber 31 and towards the idler 33 and the rotor 28. As the idler teeth 51 and rotor teeth 29 rotate past the inlet 22, fluid disposed in the idler roots 52 is swept along an upper surface 54 of the crescent 55 and liquid disposed in the spaces 53 between the rotor teeth 29 is swept along a lower surface 56 of the crescent 55. At the bottom of the pump 20 as shown in FIG. 6, the idler teeth 51 sweep along the upper surface 54 of the crescent 55 and the rotor teeth 29 sweep along the lower surface 56 of the crescent 55.

Figure 7:
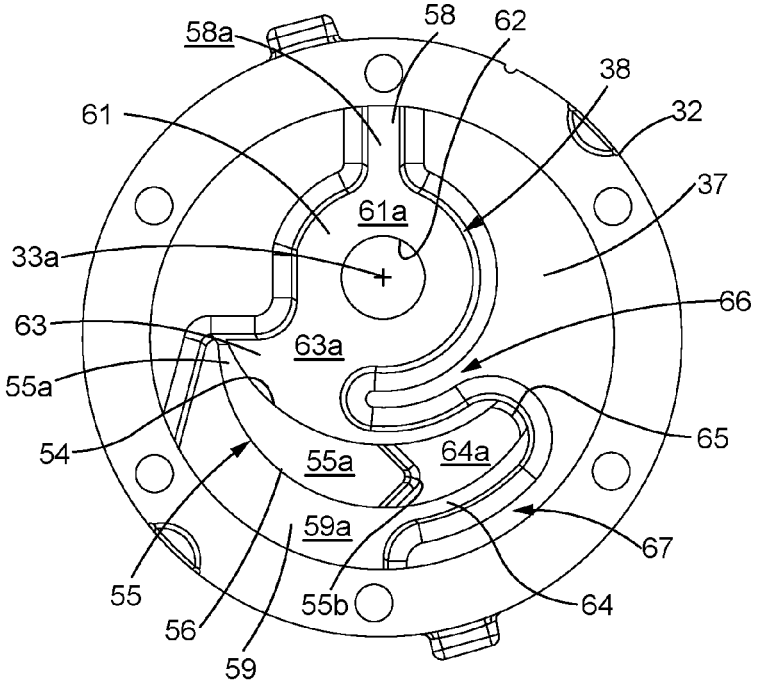
FIG. 7 is a front plan view of the head shown in FIG. 5.
Figure 8:
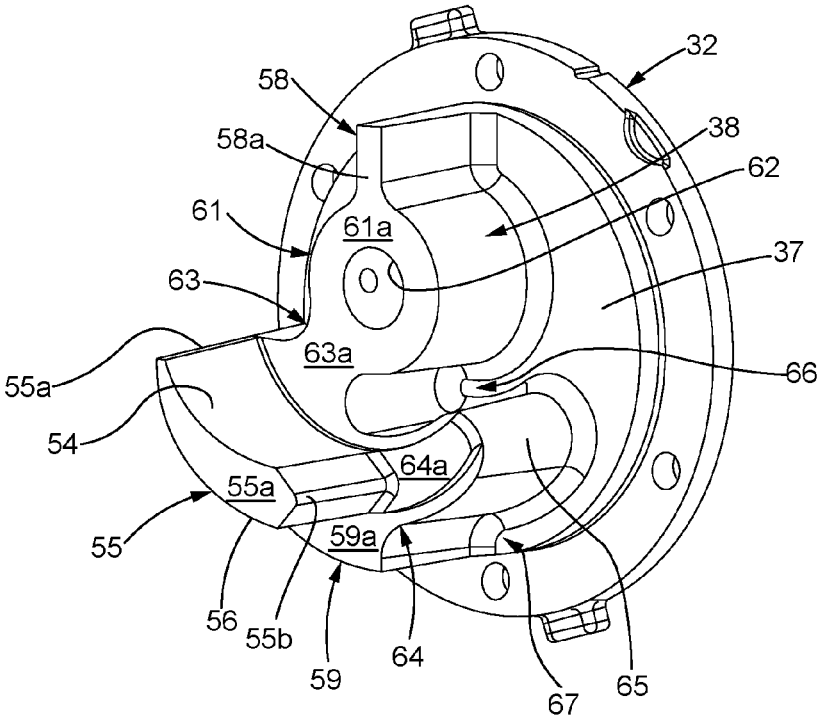
FIG. 8 is a perspective view of the head shown in FIGS. 5 and 7.

Thus, the crescent 55 serves as a seal between the rotor teeth 29 and the idler teeth 51 at the bottom of the pump 20 until the idler teeth 51 and the rotor teeth 29 reach the outlet 23 where the crescent 55 terminates at the tapered trailing end 55*a* and fluid flows out of the pump 20. The crescent 55 also features a tapered or pointed leading end 55*b*. which facilitates or increases the feeding of the liquid at high pump speeds. As shown in FIG. 6, the idler 33 or idler teeth 51 and the rotor 28 or rotor teeth 29 come into a simultaneous sealing engagement with the crescent 55 to provide a seal at the bottom of the pump 20 between the inlet 22 and outlet 23. Simultaneously, a seal at the top of the pump 20 is created by the engagement between one of the idler teeth 51 and the upper wall 57 of the casing 21 and the intermeshing of that idler tooth 51 between two rotor teeth 29 as shown at the top of FIG. 6. The upper wall 57 of the casing 21 illustrated in FIG. 6 also abuts the upper wall 58 of the boss 38 of the head 32, as illustrated in FIGS. 7-8. The simultaneous sealing engagement between the idler 33 and the upper surface 54 of the crescent 55, between the rotor 28 and the lower surface 56 of the crescent and between the idler 33 and the upper wall 57 of the casing 21 all combine to reduce slip while operating the pump 20 at high speeds.

Continuing with FIGS. 7-8, the boss 38 also includes a lower wall 59. Additionally, the boss 38 includes an idler support 61, which supports the idler 33 in the pump chamber 31 and includes an opening 62 for receiving the idler pin 35 and the idler bushing 34 (FIG. 5). The boss 38 further includes a middle wall 63 that connects the idler support 61 to a crescent support 64. The crescent support 64 supports the crescent 55 in a proper orientation so that the idler teeth 51 sweep along the upper surface 54 of the crescent 55 and so that the rotor teeth 29 sweep along the lower surface 56 of the crescent 55 at the bottom of the pump 20. As shown in FIGS. 7-8, the idler support 61 terminates at an idler support surface 61*a*, the crescent support 64 terminates at a crescent support surface 64*a*, the upper wall 58 terminates at an upper wall surface 58*a*, the middle wall 63 terminates at middle wall surface 63*a*, and the lower wall 59 terminates at a lower wall surface 59*a*. The idler support surface 61*a*, crescent support surface 64*a*, upper wall surface 58*a*, middle wall surface 63*a* and lower wall surface 59*a* may be coplanar.

The crescent support 64 includes a liquid directing step 65. The liquid directing step 65, in combination with the middle wall 63, the idler support 61 and the inner surface 37 of the head 32 form an idler feed slot 66. The idler feed slot 66 facilitates the feeding of liquid from the inlet 22 to the idler roots 52 for more efficient pumping and reduces cavitation at high pumping speeds. Similarly, the liquid directing step 65 in combination with the lower wall 59, the casing 21 and the inner surface 37 of the head 32 form a rotor feed slot 67. The rotor feed slot 67 facilitates the channeling of liquid from the inlet 22 to the spaces 53 between the rotor teeth 29 at the bottom of the pump 20. Like the idler feed slot 66, the rotor feed slot 67 contributes to the ability of the pump 20 to operate at high speeds with reduced risk of cavitation. The crescent 55 extends outward away from the inner surface 37 of the head 32 into the pump chamber 31 before terminating at an outer crescent surface 55*a*. The reader will note that the outer crescent surface 55*a* is disposed farther into the pump chamber 31 than the crescent support surface 64*a* as best seen in FIG. 8.

Figure 9:
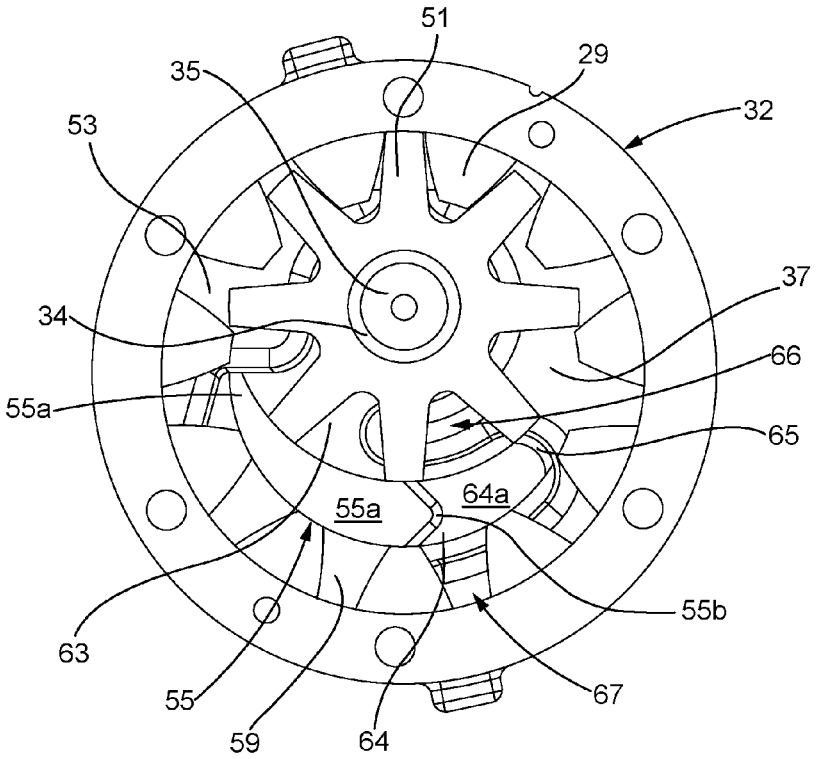
FIG. 9 is a front plan view of the head and idler shown in FIGS. 5 and 6 and a sectional view of the rotor, particularly illustrating the engagement between the idler and rotor teeth.
Figure 10:
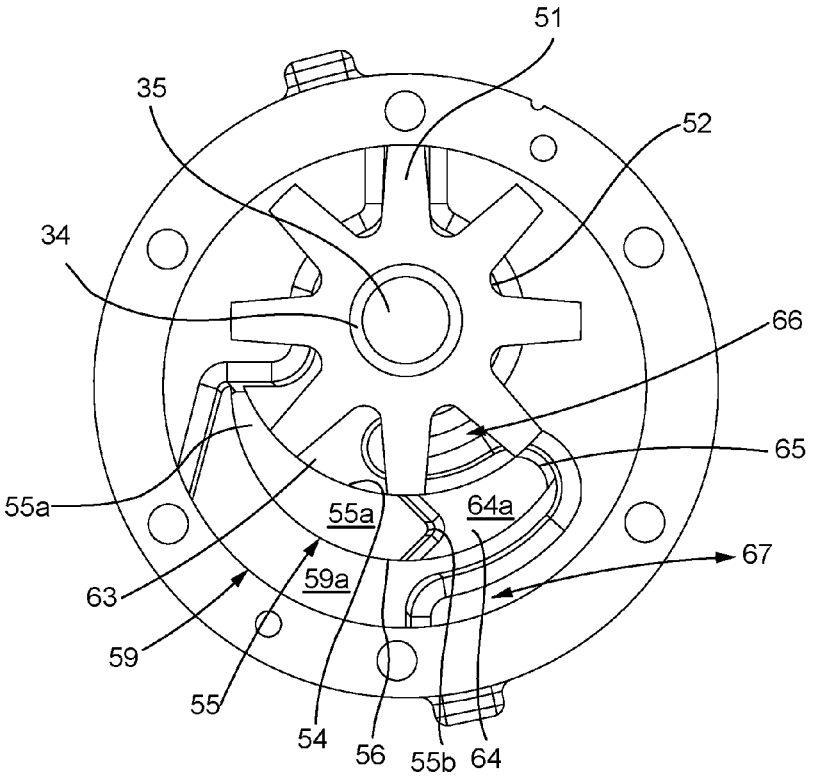

The idler feed slot 66 and rotor feed slot 67 are further illustrated in FIGS. 9-10. The idler feed slot 66 is separated from the rotor feed slot 67 by the liquid directing step 65, which is essentially an extension of the crescent support 64 or is a portion of the crescent support 64 that extends arcuately beyond the crescent 55 and towards the inlet 22. Segregating the incoming liquid into portions delivered to the idler feed slot 66 and the rotor feed slot 67 reduces turbulence and cavitation and enables the pump 20 to operate at higher speeds. Further, the liquid directing step 65, idler feed slot 66 and rotor feed slot 67 help eliminate non-ideal flow patterns, thereby allowing more liquid to enter the pump 20 before directing the liquid to either above the crescent 55 (or into the idler feed slot 66) or below the crescent 55 (or into the rotor feed slot 67).

In the embodiment shown, the boss 38 creates the idler feed slot 66 and rotor feed slot 67 by supporting the idler 33 and the crescent 55 outward away from the inner surface 37 of the head 32. This gap or clearance between the inner surface 37 of the head 32 and both the idler 33 and rotor 28 creates the space necessary for the formation of the idler feed slot 66 and rotor feed slot 67. The additional space required for the formation of the idler feed slot 66 and rotor feed slot 67 accommodates a larger inlet 22 for increased pumping speeds.

Figure 11:
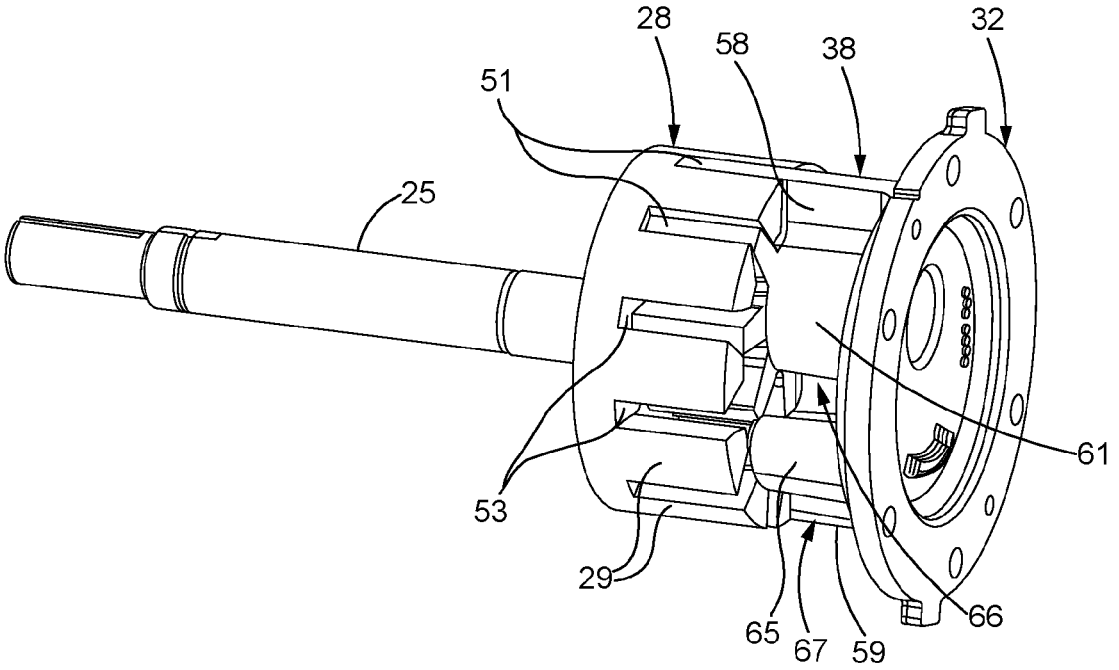
FIG. 11 is a perspective view of the head, idler and rotor.

As shown in FIG. 11, the boss 38 includes an upper wall 58 that blocks fluid from flowing from the outlet 23 back to the inlet 22 and, instead, forces fluid to exit through the outlet 23. Further, the lower wall 59 forms part of the rotor feed slot 67 and forces liquid between the rotor teeth 29 before it exits through the outlet 23.

INDUSTRIAL APPLICABILITY

An internal gear pump 20 enables faster operation with reduced risk of or simply reduced cavitation. The disclosed pump 20 can operate at higher speeds because of the combination of an idler feed slot 66 and a rotor feed slot 67 that is created by a head 32 and a boss 38. Depending on the size of the pump 20, the pump 20 can operate at up to 20-30% higher speeds than internal gear pumps with just idler feed slots, such as that disclosed in commonly assigned U.S. Pat. No. 6,149,415, and the pump 20 can operate at up to twice the speed of internal gears pumps that predate U.S. Pat. No. 6,149,415. The boss 38 includes an idler support 61 that supports the idler 33 in the pump chamber 31 and spaced apart from the inner surface 37 of the head 32. Similarly, the crescent 55 is also supported away from the inner surface 37 by the boss 38 or, more specifically, by the crescent support 64 of the boss 38. The spacing between the idler 33, the crescent support 64, and the axial ends of the rotor teeth 29 provide the needed space to form the idler feed slot 66 and the rotor feed slot 67. Specifically, the idler support 61, the middle wall 63, the liquid directing step 65 and the inner surface 37 of the head 32 may define an idler feed slot 66. Further, the rotor feed slot 67 may be defined by the casing 21, the lower wall 59, the liquid directing step 65 and the inner surface 37 of the head 32. Thus, liquid entering through the inlet 22 is separated by the liquid directing step 65 into a portion that enters the idler feed slot 66 and another portion that enters the rotor feed slot 67. Dividing the incoming liquid in this way enables the pump 20 to operate at higher speeds, lower turbulence, and reduced risk of cavitation and/or reduced cavitation.

While only certain embodiments have been set forth, alternative embodiments and various modifications will be apparent from the above description to those skilled in the art. These and other alternatives are considered equivalents and within the spirit and scope of the present disclosure.

The invention claimed is:

1. An internal gear pump comprising:

a casing comprising an inlet, an outlet, an open outboard end and an inboard end through which a rotor shaft passes, the open outboard end enclosed by a head, the head and casing defining a pump chamber, the rotor shaft connected to a rotor disposed in the pump chamber, the head including an inner surface that faces the pump chamber, the inner surface connected to a boss that extends into the pump chamber, the boss comprising an idler support connected to a crescent support, the idler support rotatably connected to an idler, the crescent support partially covered by and connected to a crescent that extends away from the head and that is disposed below the idler, the crescent support further comprising a liquid directing step that extends from the crescent and towards the inlet, the boss comprising a lower wall disposed below the crescent support and that extends from the crescent support downward to the casing, the boss, inner surface of the head and casing defining a rotor feed slot between the liquid directing step and the casing and extending from the lower wall towards the inlet for providing communication between the inlet and the rotor.

2. The pump of claim 1 wherein the boss further comprises a middle wall that connects the crescent support to the idler support, the boss and head defining an idler feed slot between the liquid directing step and the idler support and extending from the middle wall towards the inlet for providing communication between the inlet and the idler.

3. The pump of claim 2 wherein the boss further comprises an upper wall disposed opposite the idler from the crescent and that extends from the idler support upward to the casing.

4. The pump of claim 3 wherein the upper wall, middle wall, lower wall, idler support and crescent support terminate at surfaces that are coplanar with respect to each other.

5. The pump of claim 1 wherein the crescent includes a tapered leading edge.

6. The pump of claim 1 wherein the boss further comprises an upper wall disposed opposite the idler from the crescent and that extends from the idler support upward to the casing.

7. The pump of claim 6 wherein the upper wall, lower wall, idler support and crescent support terminate at surfaces that are coplanar with each other.

8. The pump of claim 1 wherein the idler support and crescent support terminate at surfaces that are coplanar with respect to each other.

9. The pump of claim 1 wherein the pump chamber has a central axis and the idler rotates about an idler axis, the inlet connects to the pump chamber by an inlet passageway and outlet connects to the pump chamber by an outlet passageway, the inlet and inlet passageway being mirror images of the outlet and outlet passageway respectively with respect to a plane mirror that passes through the central axis and the idler axis.

10. An internal gear pump comprising:

a casing comprising an inlet, an outlet, an open outboard end and an inboard end through which a rotor shaft passes, the open outboard end enclosed by a head, the head and casing defining a pump chamber, the pump chamber has a central axis, the rotor shaft connected to a rotor disposed in the pump chamber, the head including an inner surface that faces the pump chamber, the inner surface connected to a boss extending from the inner surface into the pump chamber, the boss comprising an idler support connected to a crescent support, the idler support rotatably connected to an idler, the idler rotates about an idler axis, the crescent support partially covered by and connected to a crescent that extends away from the head and that is disposed below the idler, the crescent support further comprising a liquid directing step that extends from the crescent and towards the inlet, the rotor comprising a plurality of circumferentially disposed rotor teeth extending radially inwards towards the central axis, the idler comprising a plurality of idler teeth extending radially outwards away from the idler axis, the boss comprising a lower wall disposed below the crescent support and that extends from the crescent support downward to the casing, the boss, casing and inner surface of the head defining a rotor feed slot between the liquid directing step and the casing and extending from the lower wall towards the inlet for providing communication between the inlet and the rotor teeth.

11. The pump of claim 10 wherein the boss further comprises a middle wall that connects the crescent support to the idler support, the boss and head defining an idler feed slot between the liquid directing step and the idler support and extending from the middle wall towards the inlet for providing communication between the inlet and the idler teeth.

12. The pump of claim 11 wherein the boss further comprises an upper wall disposed opposite the idler axis from the crescent and that extends from the idler support upward to the casing.

13. The pump of claim 12 wherein the upper wall, middle wall, lower wall idler support and crescent support terminate at surfaces that are coplanar with respect to each other.

14. The pump of claim 10 wherein the crescent includes a tapered leading edge.

15. The pump of claim 10 wherein the boss further comprises an upper wall disposed opposite the idler axis from the crescent and that extends from the idler support upward to the casing.

16. The pump of claim 15 wherein the upper wall, lower wall, idler support and crescent support terminate at surfaces that are coplanar with respect to each other.

17. The pump of claim 10 wherein the idler support and crescent support terminate at surfaces that are coplanar with each other.

18. The pump of claim 10 wherein the inlet connects to the pump chamber by an inlet passageway and outlet connects to the pump chamber by an outlet passageway, the inlet and inlet passageway being mirror images of the outlet and outlet passageway respectively with respect to a plane mirror that passes through the central axis and the idler axis.

19. A method for pumping liquid at a high speed, the method comprising:

providing an internal gear pump comprising a casing comprising an inlet, an outlet, an open outboard end and an inboard end through which a rotor shaft passes, the open outboard end enclosed by a head, the head and casing defining a pump chamber, the pump chamber has a central axis, the rotor shaft connected to a rotor disposed in the pump chamber, the head including an inner surface that faces the pump chamber, the inner surface connected to a boss extending from the inner surface into the pump chamber, the boss comprising an idler support connected to a crescent support by a middle wall, the idler support rotatably connected to an idler that rotates about an idler axis, the boss and head defining an idler feed slot between the liquid directing step and the idler support and extending from the middle wall towards the inlet, the crescent support partially covered by and connected to a crescent that extends away from the head and that is disposed below the idler, the crescent support further comprising a liquid directing step that extends from the crescent and towards the inlet, the rotor comprising a plurality of circumferentially disposed rotor teeth extending radially inwards towards the central axis, the idler comprising a plurality of idler teeth extending radially outwards away from the idler axis and disposed radially within the rotor teeth, the boss comprising a lower wall disposed below the crescent support and that extends from the crescent support downward to the casing, the boss, casing and inner surface of the head defining a rotor feed slot between the liquid directing step and the casing and extending from the lower wall towards the inlet;

rotating the rotor shaft and rotor;

directing fluid from the inlet and through the idler feed slot to the idler teeth; and directing fluid from the inlet and through the rotor feed slot to the rotor teeth.

20. The method of claim 19 further comprising providing an upper wall disposed opposite the idler axis from the crescent and that extends from the idler support upward to the casing;

blocking flow from the inlet to the outlet and vice versa with the upper and lower walls without said flow first being fed to either the rotor or the idler.

* * * * *